US009315300B2

(12) United States Patent
Moras et al.

(10) Patent No.: US 9,315,300 B2
(45) Date of Patent: Apr. 19, 2016

(54) DRAWTAPE WITH INCREASED ELONGATION AND DRAWTAPE BAG USING SAME

(75) Inventors: Wayne J. Moras, Chatham, IL (US); Steven P. Long, Jacksonville, IL (US); Stephen H. Holt, Jacksonville, IL (US); Ryan M. Horstmeyer, Jacksonville, IL (US)

(73) Assignee: REYNOLDS CONSUMER PRODUCTS INC., Lake Forest, IL (US)

( * ) Notice: Subject to any disclaimer, the term of this patent is extended or adjusted under 35 U.S.C. 154(b) by 912 days.

(21) Appl. No.: 13/590,514

(22) Filed: Aug. 21, 2012

(65) Prior Publication Data

US 2014/0056544 A1 Feb. 27, 2014

(51) Int. Cl.
*B65D 33/28* (2006.01)

(52) U.S. Cl.
CPC ..... *B65D 33/28* (2013.01)

(58) Field of Classification Search
CPC ..... B65D 33/28
See application file for complete search history.

(56) References Cited

U.S. PATENT DOCUMENTS

| | | | | |
|---|---|---|---|---|
| 3,365,315 | A | 1/1968 | Beck et al. | |
| 3,867,083 | A | 2/1975 | Herrington | |
| 3,959,425 | A | 5/1976 | Herrington | |
| 3,976,732 | A | 8/1976 | Herrington | |
| 4,022,558 | A | 5/1977 | Herrington | |
| 4,069,292 | A | 1/1978 | Herrington et al. | |
| 4,118,453 | A | 10/1978 | Herrington | |
| 4,174,932 | A | 11/1979 | Herrington | |
| 4,386,125 | A | 5/1983 | Shiraki et al. | |
| 4,476,180 | A | 10/1984 | Wnuk | |
| 4,597,750 | A | 7/1986 | Boyd et al. | |
| 4,624,654 | A | 11/1986 | Boyd et al. | |
| 4,767,726 | A | 8/1988 | Marshall | |
| 4,813,947 | A | 3/1989 | Korpman | |
| 4,854,983 | A | 8/1989 | Bryniarski et al. | |
| 5,959,006 | A * | 9/1999 | Pungtrakul | C08J 5/18 524/1 |
| 6,059,458 | A | 5/2000 | Belias et al. | |
| 6,402,377 | B1 | 6/2002 | Vo et al. | |
| 6,602,174 | B1 | 8/2003 | Haverfield et al. | |
| 8,167,490 | B2 | 5/2012 | Hu et al. | |
| 2003/0072505 | A1 * | 4/2003 | Pihl | B65D 33/28 383/75 |
| 2005/0063622 | A1 * | 3/2005 | Kannabiran | B65D 33/28 383/75 |

* cited by examiner

*Primary Examiner* — Walter B Aughenbaugh
(74) *Attorney, Agent, or Firm* — Baker Botts L.L.P.

(57) ABSTRACT

Drawtape includes a film of a polymeric blend of a minor polymer component of linear low density polyethylene and a major polymer component of medium density polyethylene and/or high density polyethylene. The drawtape of the disclosed subject matter is capable of a strong seal with a commercial polymeric bag, and provides a high elongation prior to tape failure or seal failure. Drawtape bag and method of making the drawtape are also provided.

31 Claims, 5 Drawing Sheets

DRAWTAPE WITH INCREASED ELONGATION AND DRAWTAPE BAG USING SAME

BACKGROUND OF THE DISCLOSED SUBJECT MATTER

1. Field of the Disclosed Subject Matter

The disclosed subject matter relates generally to drawtapes, drawtape bags, and processes of making drawtapes. Particularly, the disclosed subject matter relates to drawtapes including a film made of a polymeric blend capable of increased elongation prior to breaking of the drawtape or of the seal with the bag.

2. Description of Related Art

Waste bags having a drawtape disposed or sealed proximate the mouth of the bag are generally known as drawtape bags. Conventional drawtapes produced for drawtape bags are typically made of high density polyethylene ("HDPE") as a base material. Such drawtapes can be produced as either a monolayer or a multilayer film, and sealed or attached at select locations to the panels of the bag proximate the top. Drawtapes often must be capable of carrying heavy loads without breaking of the drawtape or of the seal with bag. HDPE is typically used as the base material in drawtape films to provide load carrying strength, because HDPE polymers generally provide greater tensile strength than polymers with lower densities. However, stronger polymers such as HDPE also tend to form weaker heat seals with the panels of the waste bag than do polymers of lower base density. Another disadvantage of drawtapes made from HDPE or other stronger polymers is the resulting discomfort to the user when holding the drawtape due to the relatively little yield of the polymer with a heavy load.

As such, there remains a need for a drawtape that is economical and ergonomical, as well as sufficiently strong to carry a heavy load within the bag without breaking the drawtape or the seal with the bag.

SUMMARY OF THE SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof.

To achieve these and other advantages and in accordance with the purpose of the disclosed subject matter, as embodied and broadly described, the disclosed subject matter includes a drawtape comprising a film of a polymeric blend of a minor polymer component of between about 5 wt % and about 50 wt % linear low density polyethylene ("LLDPE") and a major polymer component selected from medium density polyethylene ("MDPE"), HDPE, or combinations thereof.

As embodied herein, the film contains between about 10 wt % and about 40 wt % LLDPE. In particular embodiments, the film contains between about 20 wt % and about 30 wt % LLDPE. In one specific embodiment, the film contains about 25 wt % LLDPE.

The LLDPE of the drawtape can have a melt index of between about 0.25 and about 3.0 grams per 10 minutes per ASTM D1238 (2010). Alternatively, the melt index of the LLDPE can be between about 0.50 and about 1.0 grams per 10 minutes per ASTM D1238 (2010). In another embodiment, the melt index is between about 0.80 and about 0.90 grams per 10 minutes per ASTM D1238 (2010).

As embodied herein, the LLDPE of the drawtape can have a base density of between about 0.910 and 0.925 grams per cubic centimeter per ASTM D792 (2008). The base density of the LLDPE can be between about 0.916 and 0.920 grams per cubic centimeter per ASTM D792 (2008). The base density of the polymer refers to the density as measured for the neat material, without additives such as antiblock agents or colorants.

The film can further include an alpha olefin comonomer. In certain embodiments, the comonomer has from about 4 to about 8 carbon atoms. In one embodiment, the comonomer is selected from propylene, 1-butene, 1-pentene, 1-hexene, and 1-octene.

As embodied herein, the major polymer component of the drawtape has a melt index of between about 0.050 and about 0.50 grams per 10 minutes per ASTM D1238 (2010). In one embodiment, the melt index of the major polymer is between about 0.10 and about 0.20 grams per 10 minutes per ASTM D1238 (2010).

The major polymer can have a base density of between about 0.926 and about 0.959 grams per cubic centimeter per ASTM D792 (2008). In particular embodiments, the major polymer has a base density of between about 0.939 and about 0.940 grams per cubic centimeter per ASTM D792 (2008).

The drawtape can further include one or more additives. Non-limiting examples of additives include colorants, slip additives, antiblock agents, processing aids, or combinations thereof. The drawtape can be a single layer.

The disclosed subject matter also includes a drawtape bag containing first and second thermoplastic body panels joined along a pair of opposing sides and a bottom bridging the opposing sides, the joined first and second body panels defining a mouth disposed opposite the bottom, and a drawtape disposed proximate the mouth of the bag. The drawtape includes a film of a polymeric blend of a minor polymer component of between about 5 wt % and about 50 wt % LLDPE and a major polymer component selected from MDPE, HDPE, or combinations thereof.

The drawtape of the drawtape bag can include any of the features or compositions as noted above and described in more detail herein. In particular embodiments, the drawtape of the drawtape bag has a load carrying capacity of at least about 10 lbs in a tensile direction in an ASTM D882 (2010) test. In one embodiment, the drawtape of the drawtape bag has a load carrying capacity of at least about 14 lbs in a tensile direction in an ASTM D882 (2010) test. The drawtape bag can have a load carrying capacity of less than or equal to about 17 lbs in a tensile direction in an ASTM D882 (2010) test. The elongation at break of the drawtape can be at least about 425% in an ASTM D882 (2010) test. For example, the elongation at break of the drawtape can be about 460% in an ASTM D882 (2010) test.

As embodied herein, the drawtape is secured to at least one of the first and second panels of the drawtape bag. The drawtape can be secured by a thermal bond. The drawtape of the disclosed subject matter is capable of elongation without failure of the drawtape or the thermal bond in a Tape Pull Test. Particularly, the drawtape is capable of elongation in excess of 120%, and even in excess of 135%, without failure of the drawtape or the thermal bond in a Tape Pull Test. For example, the drawtape is capable of about 138% elongation without failure of the drawtape or the thermal bond in a Tape Pull Test.

The disclosed subject matter also includes a method of making a drawtape including providing a polymeric blend comprising a minor polymer component of between about 5 wt % and about 50 wt % LLDPE and a major polymer component selected from MDPE, HDPE, or combinations thereof, forming the polymeric blend into a film, and shaping the film into a drawtape.

In one embodiment, the method includes dry blending the LLDPE with the major polymer component. In particular embodiments, forming the polymeric blend into a film includes film blowing. The film can be highly oriented in the machine direction when film blowing the polymeric blend.

It is to be understood that both the foregoing general description and the following detailed description are exemplary and are intended to provide further explanation of the disclosed subject matter claimed.

The accompanying figures, which are incorporated in and constitute part of this specification, are included to illustrate and provide a further understanding of the method and system of the disclosed subject matter. Together with the description, the drawings serve to explain the principles of the disclosed subject matter.

DETAILED DESCRIPTION OF THE SUBJECT MATTER

Figure 1:
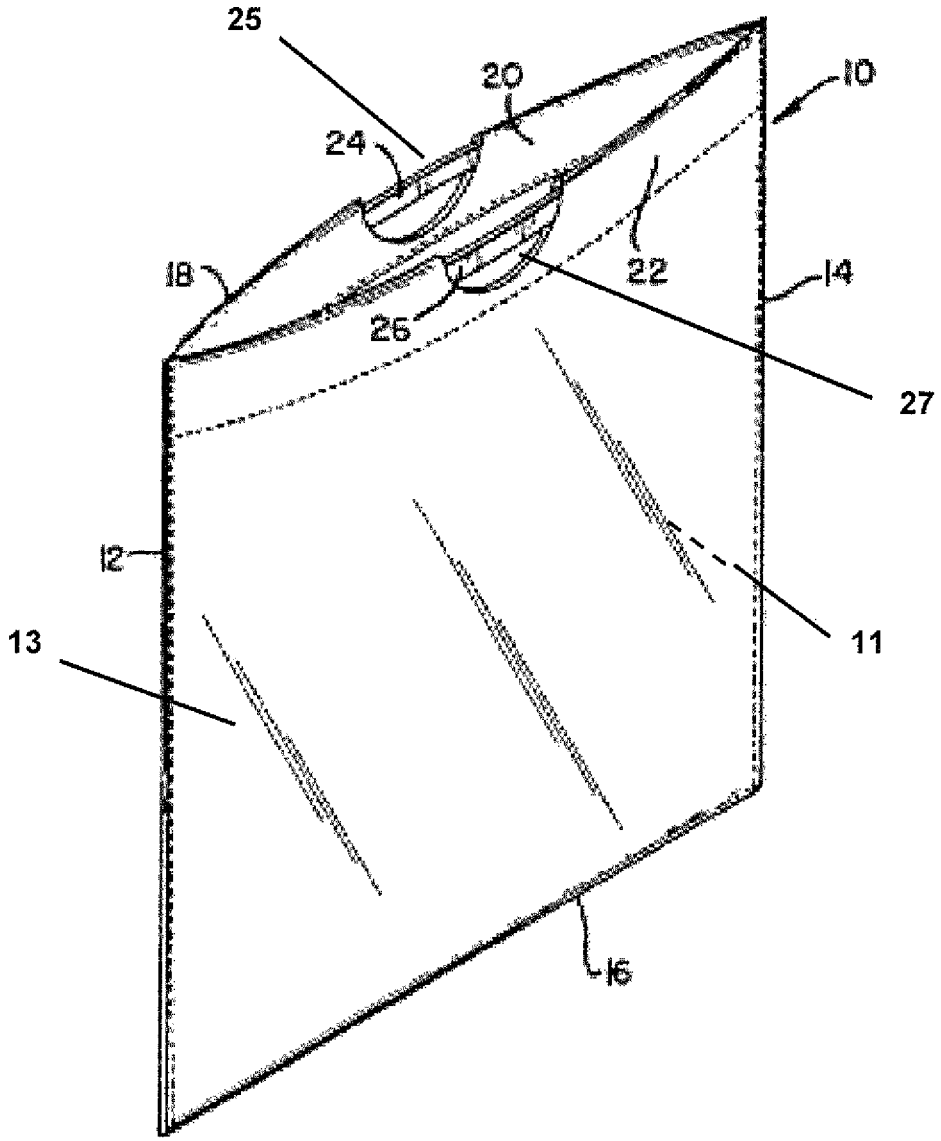
FIG. 1 is a perspective view of an exemplary drawtape bag of the disclosed subject matter.

The apparatus and method disclosed herein have a number of practical applications. For example, the drawtape bag of the disclosed subject matter can be used for the collection, storage and transportation of a variety of items, including waste, refuse and other disposable articles.

In accordance with the disclosed subject matter herein, a drawtape is provided comprising a film of a polymeric blend including a minor polymer component of between about 5 wt % and about 50 wt % linear low density polyethylene and a major polymer component selected from MDPE, HDPE, or combinations thereof.

In accordance with another aspect of the disclosed subject matter, a drawtape bag is provided comprising a first and second thermoplastic body panels joined along a pair of opposing sides and a bottom bridging the opposing sides, the joined first and second body panels defining a mouth disposed opposite the bottom; and a drawtape disposed proximate the mouth of the bag. The drawtape comprises a film of a polymeric blend including a) a minor polymer component of between about 5 wt % and about 50 wt % linear low density polyethylene; and b) a major polymer component selected from MDPE, HDPE, or combinations thereof.

Furthermore, a method of making the drawtape comprises providing a polymeric blend comprising a) a minor polymer component of between about 5 wt % and about 50 wt % linear low density polyethylene; and b) a major polymer component selected from medium density polyethylene, high density polyethylene, or combinations thereof; forming the polymeric blend into a film; and shaping the film into a drawtape.

Reference will now be made in detail to the various aspects of the disclosed subject matter. For purpose of understanding, the method of the subject matter will be described in conjunction with the detailed description of the drawtape and drawtape bags. The accompanying figures, where like reference numerals refer to identical or functionally similar elements throughout the separate views, serve to further illustrate various embodiments and to explain various principles and advantages all in accordance with the disclosed subject matter.

Drawtape Bag

For purposes of illustration and not limitation, reference will now be made to a representative embodiment of a drawtape bag. As shown in FIG. 1, and embodied herein, a drawtape bag 10 is provided comprising first and second thermoplastic body panels 11 and 13 joined along a pair of opposing sides 12, 14 and a bottom 16 bridging the opposing sides. The joined first and second body panels define a mouth 18 disposed opposite the bottom 16. A drawtape 25 is disposed proximate the mouth 18 of the bag. As embodied herein, the drawtape 25 comprises two strips 24 and 26 joined together at opposing ends proximate the opposing sides of the first and second body panels 11 and 13. The drawtape can be secured directly to the panels, such as at the opposing sides. Furthermore, and as embodied herein, the bag can include tubular hems 20 and 22 formed by the body panels 11 and 13 to house the drawtape. Two access hole 27 is defined within the hem to expose the drawtape 24 and 26, allowing the drawtape to be pulled through the holes to close the bag and/or to be used as a handle.

The body panels 11 and 13 can be made from a wide range of suitable polymeric materials, such as LLDPE, low density polyethylene ("LDPE"), MDPE, HDPE, high molecular weight high density polyethylene, polypropylenes, other polyolefins, polystyrenes or combinations thereof. In addition, the body panels can comprise more than one layer by using, for example, the above polymers. In a multi-layered body panel, the layers of the body panels can be coextruded. Each body panel can have a thickness of from about 0.2 mils to about 5 mils, or about 0.4 mils to about 2 mils, or particularly about 0.7 mils to about 1.3 mils.

A variety of techniques can be used to fold, seal, and cut a web of the desired polymeric material into the corresponding shape and structure of the bag. For example, and for purpose of illustration and not limitation, a web of polymeric material can be folded along its axis to form a bottom of the bag and first and second panels extending therefrom. The edges of the web opposite the bottom can be folded back toward the bottom to define a hem along the top of each panel. Drawtape holes can be formed in each hem. A strip of drawtape material, as described further below, can be disposed within each hem. The opposing sides of the bag can then be secured together, such as by a heated bar to form a thermal bond. In this manner the opposing ends of the drawtape strips likewise can be bonded together, and to the corresponding panels and/or hems if desired.

In another embodiment, the bag is prepared by extruding a thermoplastic in a machine direction, flattening the tube by rollers, and then slitting the tube in half along a center line. Each half of the tube includes a pair of thermoplastic panels joined to each other along a bottom disposed in the machine direction. The panels are separable from each other along a mouth end proximate to the center slit line and opposite the bottom. The panels are passed through a static folding mechanism, or the like, in the machine direction to produce a hem on each panel along the mouth. A cutting mechanism creates drawtape holes in the hem on each sheet at regular distance intervals corresponding to a predetermined width of the drawtape bags produced by the manufacturing method. The drawtape holes in the hem on one of the sheets coincide with the respective drawtape holes in the hem on the other of the sheets for access to the drawtape therein.

In either embodiment, the drawtape is continuously fed from a supply roll and inserted into the hem on each panel. A static heat sealing mechanism, such as heated blades, generates a hem seal in the machine direction which attaches the hem on each panel to the respective panel. A heat sealing mechanism generates drawtape seals to attach the drawtape housed within the hem on one of the panels to the drawtape housed within the hem on the other of the sheets. These drawtape seals are transverse to the machine direction.

The heat sealing mechanism also creates the anchor seal between the drawtape and the respective panel of the bag. A heat sealing and perforation mechanism generates side seal structures transverse to the machine direction and disposed at regular distance intervals corresponding to the predetermined width of the drawtape bags produced by the manufacturing method. Each side seal structure includes a perforation line disposed between a pair of spaced seal lines. The perforation line allows the sheets to be separated into the individual drawtape bags. The bags can then be packaged in a dispensing box for sale to consumers. Suitable bags and methods of making the same are described in U.S. Pat. No. 4,597,750 (to Boyd et al.), U.S. Pat. No. 4,624,654 (to Boyd et al.), U.S. Pat. No. 4,854,983 (to Bryniarski et al.), U.S. Pat. No. 6,059,458 (to Belias et al.), U.S. Pat. No. 6,402,377 (to Vo et al.), U.S. Pat. No. 6,602,174 (to Haverfield et al.), and U.S. Pat. No. 8,167,490 (to Hu et al.), each of which is incorporated herein by reference in its entirety.

Drawtape

With particular reference now to the drawtape, and in accordance with the disclosed subject matter, a drawtape is provided comprising a film of polymeric blend including as a minor polymer component between about 5 wt % and about 50 wt % LLDPE. As disclosed further herein, the film can comprise between about 10 wt % and about 40 wt % LLDPE, and more particularly between about 20 wt % and about 30 wt % LLDPE, or between about 20 wt % and about 25 wt % LLDPE. In a particular embodiment, the film comprises about 25 wt % LLDPE.

As embodied herein, the LLDPE melt index is between about 3.0 and about 0.25, particularly between about 1.0 and about 0.50, and more particularly between about 0.90 and about 0.80 grams per 10 minutes per ASTM D1238 (2010). In one embodiment, the LLDPE base density is between about 0.905 and about 0.930 grams per cubic centimeter; particularly between about 0.910 and about 0.925 grams per cubic centimeter; and more particularly between about 0.916 and about 0.920 grams per cubic centimeter per ASTM D792 (2008). ASTM International test methods ASTM D1238 (2010), ASTM D792 (2008), ASTM D882 (2010), and ASTM D638 (2010) are each hereby incorporated by reference in its entirety.

The LLDPE of the presently disclosed subject matter can include one or more comonomers. In particular embodiments, the LLDPE includes an alpha olefin comonomer. For example, the LLDPE includes a comonomer having from about 4 to about 8 carbon atoms. In particular embodiments, the LLDPE includes a comonomer selected from propylene, 1-butene, 1-pentene, 1-hexene, and 1-octene.

The major polymer component of the polymeric blend is selected from MDPE, HDPE, or a combination of MDPE and HDPE. For example, and as embodied herein for illustration and not limitation, the major polymer component is MDPE. In certain embodiments, the melt index of the major polymer component is between about 0.050 and about 0.50 grams per 10 minutes per ASTM D1238 (2010). Particularly, the melt index of the major polymer component is between about 0.075 and about 0.30 grains per 10 minutes, and more particularly between about 0.10 and about 0.20 grams per 10 minutes per ASTM D1238 (2010). In certain embodiments, the base density of the major polymer component is between about 0.926 and 0.959 grams per cubic centimeter; particularly between about 0.934 and 0.945 grams per cubic centimeter; and more particularly between about 0.939 and 0.940 grams per cubic centimeter per ASTM D792 (2008).

The major or minor polymer components of the presently disclosed subject matter can be produced by an olefin polymerization catalyst. In one embodiment, the catalyst includes transition metal catalysts, such as, but not limited to, Ziegler catalysts, Philips-type catalysts, and single-site catalysts. Non-limiting examples of Ziegler catalysts include titanium halides, titanium alkoxides, vanadium halides, and mixtures thereof. Non-limiting examples of Phillips-type catalysts include chromium trioxide, chromocene, and bis(triphenylsilyl)chromate. Non-limiting examples of single-site catalysts include metallocene and non-metallocene catalysts. Metallocene single-site catalysts include transition metal compounds that contain cyclopentadienyl or cyclopentadienyl derivative ligands. Non-metallocene catalysts can contain heteroatomic ligands, including, but not limited to, boraaryl, pyrrolyl, azaborolinyl or quinolinyl. In some embodiments, the catalysts are used with initiators and/or cocatalysts such as alkyl aluminum compounds, methylaluminoxane, and/or silicon dioxide.

As embodied herein, and in accordance with the disclosed subject matter, the polymeric blend consists essentially of the minor component of LLDPE and the major component of MDPE and/or HDPE. In this manner, however, and in further accordance with the disclosed subject matter, the polymeric blend of the drawtape can further include one or more additives. In one embodiment, the film of polymeric blend can contain up to about 20 wt % of additives. In particular embodiments, the film can contain less than about 15 wt % additives, or less than about 10 wt % additives.

Non-limiting examples of additives include colorants, dyes, pigments, antioxidants, antistatic agents, bonding aids, antiblocking agents, slip additives, processing aids, odor-binding substances, perfumes, fillers, brighteners, heat stabilizers, photostabilizers, foaming agents, glass bubbles, starch and metal salts for degradability, microfibers, and combinations thereof. Non-limiting examples of pigments include titanium dioxide (e.g., rutile, anatase), carbon black, copper phthalocyanine, antimony oxide, zinc oxide, calcium carbonate, fumed silica, phthalocyamine (e.g., phthalocyamine blue), ultramarine blue, cobalt blue, monoazo pigments, diazo pigments, acid dye, base dye, quinacridone, and a mixture thereof. Non-limiting examples of odor-binding substances include cyclodextrins, zeolites, inorganic and organic salts.

Suitable antistatic aids include ethoxylated amines or quaternary amines such as those described, for example, in U.S. Pat. No. 4,386,125 (to Shiraki), who also describes suitable antiblocking agents, slip agents and lubricants. Softening agents, tackifiers or lubricants are described, for example, in U.S. Pat. No. 4,813,947 (to Korpman) and include coumarone-indene resins, terpene resins, hydrocarbon resins and the like. These agents can also function as viscosity reducing aids. Suitable heat stabilizers include organic phosphates, trihydroxy butyrophenone or zinc salts of alkyl dithiocarbonate. Suitable antioxidants include hindered phenolic compounds and amines possibly with thiodipropionic acid or aromatic phosphates or tertiary butyl cresol, see also U.S. Pat. No. 4,476,180 (to Wnuk) for suitable additives and percentages. The disclosure of each of the foregoing patents is incorporated herein by reference in its entirety.

The drawtape can be reinforced with short fibers or microfibers. These fibers include polymeric fibers, mineral wool, glass fibers, carbon fibers, silicate fibers and the like. Certain particles can also be used, including carbon and pigments.

The drawtape can include other ingredients to reduce costs. In some embodiments, the drawtape also include glass bubbles or foaming agents to lower the density of drawtape and reduce cost by decreasing the LLDPE and/or major polymer content required. These agents can also be used to increase the bulk of the drawtape. Suitable glass bubbles are described in U.S. Pat. Nos. 4,767,726 and 3,365,315, which are incorporated herein by reference in their entireties. Foaming and nucleating agents used to generate bubbles in the drawtape include azodicarbonamides, azobisformamide, sodium carbonate with or without citric acid, talc, calcium carbonate, mica. Foam blowing agents include atmospheric gases, such as carbon dioxide, nitrogen or air; hydrofluorocarbon (HFC), hydrochlorofluorocarbons, (HCFCs), or perfluoro compounds (PFCs), such as HFC-134a; saturated hydrocarbons such as pentane, hexane, heptane, octane, methyl pentane and dimethyl pentane, unsaturated hydrocarbons such as pentene, 4-methylpentene, hexene, petroleum ether fractions, and halogenated hydrocarbons such as carbon tetrachloride, chloroform, ethylene dichloride, methylene chloride, or 1,1,3-trichloro-1,2,2-trifluoroethane. Another ingredient that can be added to the drawtape to lower costs is one or more fillers. Fillers, which can also function as antiblocking agents, include titanium dioxide, diatomaceous earth, talc, and calcium carbonate.

As embodied herein, for purpose of illustration and not limitation, the drawtape is a monolayer. However, in particular embodiments, the drawtape can have two or more layers. Any suitable dimension for the width and length of the drawtape can be used in accordance with the needs and desires of the user. The drawtape of the presently-disclosed subject matter generally can be provided with any suitable thickness as needed. For example, in certain embodiments the drawtape has a thickness of between about 0.5 mils and 6 mils. In particular embodiments, the drawtape has a thickness of between about 1 mil and 5 mils, or about 1.5 mils and 3 mils. As embodied herein, for illustration and not limitation, the drawtape is about 2.3 mils thick.

The drawtape can be formed as a film cut into two or more suitable strips and joined at opposing ends as previously described. Alternatively, the drawtape can be formed as a film in a continuous loop, or alternatively as a single strip, which is joined together at its ends to define a continuous loop.

As such, the drawtape of the disclosed subject matter is capable of a wide variety of potential uses.

Method of Making a Drawtape

In accordance with another aspect of the disclosed subject matter, a method of making a drawtape is provided. As embodied herein, the method of making a drawtape includes providing a polymeric blend containing a minor polymer component of between about 5 wt % and about 50 wt % linear low density polyethylene and a major polymer component selected from medium density polyethylene, high density polyethylene, or combinations thereof as described in detail above. Any suitable method of mixing and prepping the components can be used to create a polymeric blend for foaming a film. For example, in one embodiment, the method includes dry blending the linear low density polyethylene with the major polymer component. In certain embodiments, dry blending can include obtaining LLDPE and the major polymer component in dry form, and then mixing the two components together to form an even composition. The components can then be heated and blended together for subsequent processing using known techniques.

The additives as described above, to the extent desired, can be added to the polymeric blend after the LLDPE and major polymer component have been blended. Alternatively, the additives can be added to, or incorporated into, the LLDPE prior to blending with the major polymer component. In another embodiment, the additives can be added to, or incorporated into, the major polymer component prior to blending with the LLDPE.

Once blended, the polymeric blend can then be formed into a film using known techniques, such as extrusion or film blowing processes. For example, and as embodied herein, film blowing the polymeric blend into a film of suitable dimensions. For purpose of illustration and not limitation, the film can be produced by extrusion through an annular die and then blowing the extrusion into a tubular film by forming a bubble which is collapsed between nip rollers after solidification. If the film is a multilayer film, then the various layers can be coextruded. In one embodiment, extrusion is carried out at a temperature in the range of between about 160° C. to about 240° C. The film can be cooled by blowing gas, e.g., air, at a temperature of between about 5° C. to about 50° C. Once formed, the film can then be slit, cut, perforated, or converted to the desired shape and size of the drawtape.

In accordance with another aspect of the disclosed subject matter, the film can be highly oriented in the machine direction ("MD") when film blowing the polymeric blend. In this manner, the film can be highly oriented in the machine direction during the film blowing process to provide MD tensile strength that would not normally be typical for the blend density employed. In certain embodiments, higher than typical levels of MD orientation are utilized in the process for the desired levels of tensile load at break with the lower blend base density.

For example, and not limitation, the high MD orientation can be achieved by utilizing a low Blow-Up Ratio ("BUR") and a very high die specific output rate. As used herein, BUR refers to the ratio of the final extruded tube diameter to the die diameter of the blown film. Generally, the lower the BUR, the lower the orientation is in the transverse direction ("TD"). The die specific output rate is the gross output in pounds per hour divided by the circumference of the die in inches. The die specific output rate is therefore expressed in units of Pounds per Hour ("PPH") per linear inch of die circumference, or PPH/inch. Hence, suitable ranges for the drawtape and method of the disclosed subject matter are generally a BUR of less than 2.0 and a die specific output rate of greater than 25 PPH/inch, preferably greater than 30 PPH/inch, and more preferably greater than 35 PPH/inch.

Method of Making a Drawtape Bag and Seal

As previously noted, and in accordance with another aspect of the disclosed subject matter, the drawtape is secured to at least one of the first and second panels 11 and 13 of the drawtape bag. The drawtape can be secured by a thermal bond or seal, although other techniques known in the art can be used. The lower polymer blend base density of the polymeric blend disclosed herein advantageously provides for sealing of the drawtape to the bag film. In particular embodiments, the lower polymer blend base density advantageously provides for a robust processing window for the sealing temperature in the film to bag conversion process.

As embodied, for the purpose of illustration and not limitation, the drawtape bag and seal can be prepared by a rotary seal drum bag machine. Generally, the bottom and hems are formed in the bag film as previously described, and then the drawtape is inserted into the hem. The bag film and drawtape are then conveyed onto the seal drum to form the seals. The bag film is held in contact with the seal drum by a blanket which surrounds the rotating seal drum. Heated seal bars mounted to the drum contact the bag to seal the tape and bag side edges.

The sealing temperature is dependent on the converting process, the sealing dwell time, the bag film and drawtape materials, and the total thickness of the film layers that are being sealed. For example, the bag machine sealing temperature range is typically 150° F. to 500° F.; particularly 350° F. to 500° F.; and more particularly 400° F. to 500° F.; for a film stack of between about 7.4 to about 9.8 mils and a seal dwell time of between about 0.5 to about 1.0 seconds.

Suitable methods of making drawtape bags and the seal for the drawtape bags are described in U.S. Pat. No. 6,402,377 (to Vo et al.) and U.S. Pat. No. 6,602,174 (to Haverfield et al.), which are incorporated herein by reference in their entireties.

Drawtape Characteristics

As embodied herein, the drawtape is capable of carrying typical loads intended for the drawtape bag. Particularly, the drawtape should not fail catastrophically by breaking of the drawtape or at the seal. For example, a greater elongation with a given load is preferred over tape failure or seal failure. Unacceptable seal failure occurs when the drawtape completely separates from the respective panel of the bag Regarding tape failure, the load carrying capacity of a drawtape can be determined using an ASTM D882 (2010) tensile test. For example, the tape samples are removed from the bags and clamped in tensile tester jaws. The tensile curves presented herein are generated with a nominal sample width of 1.0 inches, an initial grip separation of 2 inches, and a grip separation of 20.0 inches/minute.

As embodied herein, and demonstrated further below, the drawtape of the drawtape bag has a load carrying capacity of at least about 10 pounds in a tensile direction in an ASTM D882 (2010) test, and particularly the load carrying capacity of the drawtape embodied herein is at least about 14 pounds ASTM D882 (2010) test.

Figure 2:
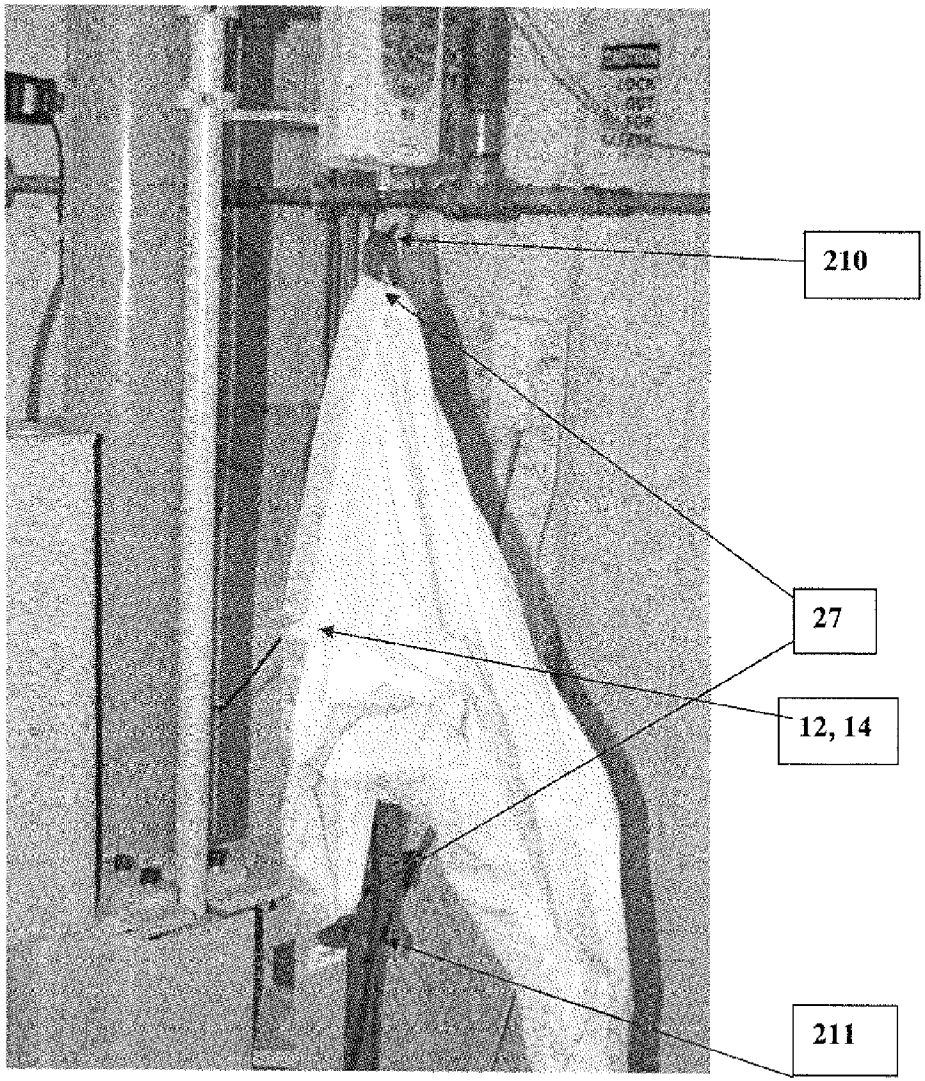
FIG. 2 is an image of a Tape Pull Tester with a three foot stroke for use in a Tape Pull Test.

Regarding seal failure, a test method known as the "Tape Pull Test" ("TPT") can be used for determining the load carrying capability of the drawtape bag, as well as the failure mode for the drawtape. Generally, the TPT is performed using a Tape Pull Tester having a top hook 210 and bottom hook 211 to capture opposing ends of the bag drawtapes, as shown in FIG. 2. The hooks are positioned a predetermined distance apart with the ends of the drawtape fully extended from each other, but are not under tension. The hooks are then moved apart by a pneumatic cylinder at a fixed speed of about 7.5 to about 9.0 seconds and a stroke or fixed length of an additional 36 inches.

The TPT includes a Chatillon force gauge to measure force applied to the drawtape. The TPT procedure is as follows. The bag is unfolded to its full, open length and width. With the top of the bag facing the tester, the portion of drawtape which is exposed at the cutout in each hem is placed on a respective hook, such that the drawtape portion proximate one panel is captured by an upper hook which is operatively coupled with the force gauge and the portion proximate the other panel is captured by the lower hook. The test is activated and the drawtape is stretched to the full length of the test cylinder, which was a 36 inch stroke for the tests performed in Example 1 below.

As the cylinder moves though the 36 inch stroke, the drawtape and seals are placed under tension. In this manner, the drawtape is stretched axially under tension and the seals undergo a peeling motion, as opposed to a straight vertical pull.

When upward travel has stopped, the maximum (peak) force gauge reading is obtained and recorded. The failure modes are:

T=Tape Failure (the drawtape breaks)

S=Seal Failure (the drawtape breaks at or near the tape seal)

If the tape successfully elongates, then the mode is E=Elongation (the tape elongates and does not break).

The cylinder is then returned to its pre-test position, the travel lever is moved to the down position and the bag is removed. The test procedure is repeated with five sample bags.

In accordance with the disclosed subject matter, the drawtape generally can elongate without breaking of the drawtape or the thermal bond in Tape Pull Test. In particular embodiments, the elongation of the drawtape is at least about 120% without tape failure (T) or seal failure (S), and in further embodiments elongation of the drawtape can be at least about 135% without failure of the drawtape or the thermal bond in a Tape Pull Test. In a particular embodiment, as set forth in the examples below, the drawtape was capable of elongation of about 138% without failure of the drawtape or the thermal bond in a Tape Pull Test.

Furthermore, and as embodied herein, the percentage of the drawtape samples that elongate without tape failure (T) or seal failure (S) is at least about 50%. Particularly, the percentage of the drawtape samples that elongate without breaking is at least about 75%, and more particularly at least about 90%.

In accordance with the disclosed subject matter, the drawtape generally can elongate without breaking in the ASTM Tensile Test D882. In particular embodiments, the elongation of the drawtape is at least about 425% in the ASTM Tensile Test D882. The elongation of the drawtape can be at least about 450%, or at least about 500% in the ASTM Tensile Test D882.

EXAMPLES

While the subject matter is capable of various modifications and alternative forms, specific embodiments thereof have been shown by way of examples, and will herein be described in detail. It should be understood, however, that it is not intended to limit the subject matter to the particular forms disclosed but, on the contrary, the intention is to cover all modifications, equivalents, and alternatives falling within the spirit and scope of the subject matter as defined by the appended claims.

The following examples are presented for purposes of illustration and description. These examples are representative but not dispositive and are not intended to be exhaustive or to limit the disclosed subject matter to those embodiments disclosed.

Example 1

Tape Pull Test

For purpose of test and comparison, drawtapes of the disclosed subject matter were prepared and sealed to Hefty® 13 gallon Tall Kitchen Garbage ("TKG") Bags produced by Reynolds Consumer Products Inc. Each TKG bag had a 0.90 mil nominal film thickness of a polyethylene film produced with LLDPE and additives including white masterbatch. Each sample drawtape was sealed to a respective bag using conventional heating seal bars at standard operating parameters.

The TPT was performed as described above. Each portion or half of the drawtape was pulled slightly out of the respective hole in the hem and attached to the two hooks which were initially spaced 21 inches apart. A cylinder then elongated the drawtape through a 36 inch stroke in approximately 8 seconds, which is a rate of approximately 270 inches per minute. Five bags of each sample were tested, and the results recorded. The TPT maximum elongation for these bags was 138%. Table 1 demonstrates the overall parameters of the TPT procedure.

TABLE 1

TPT results for 13 Gallon TKG Bags

| TPT TEST | 13G Bag |
|---|---|
| Bag width | 24.000 |
| Hook to Hook | 21.000 |
| Stroke | 36.000 |
| Draw Length | 33.000 |
| Max Elongation* | 138% |
| Sample Width | 0.9375 |

TABLE 1-continued

TPT results for 13 Gallon TKG Bags

| TPT TEST | 13G Bag |
|---|---|
| Stroke Time (sec) | 8.0 |
| Rate in/min | 270 |

*For test performed, determined as

Max Elongation = Final Stretched Length/Starting Unstretched Length
= (Stroke – Take Up to Tighten in Hooks)/Bag Width
= (Stroke – (Bag Width – Hook to Hook))/Bag Width
= Draw Length/Tape Length A series of experiments were conducted by varying the ratio of LLPDE minor polymer component to a MDPE major polymer component, while maintaining all other parameters and additives constant. The Tape Pull Test was utilized to determine the load carrying capability of each drawtape bag, as well as the failure mode for the drawtape. The Tape Pull Tester as shown in FIG. 2 was utilized to perform the test. The drawtapes tested had a bag width (seal to seal) of 24 inches.

Figure 3:
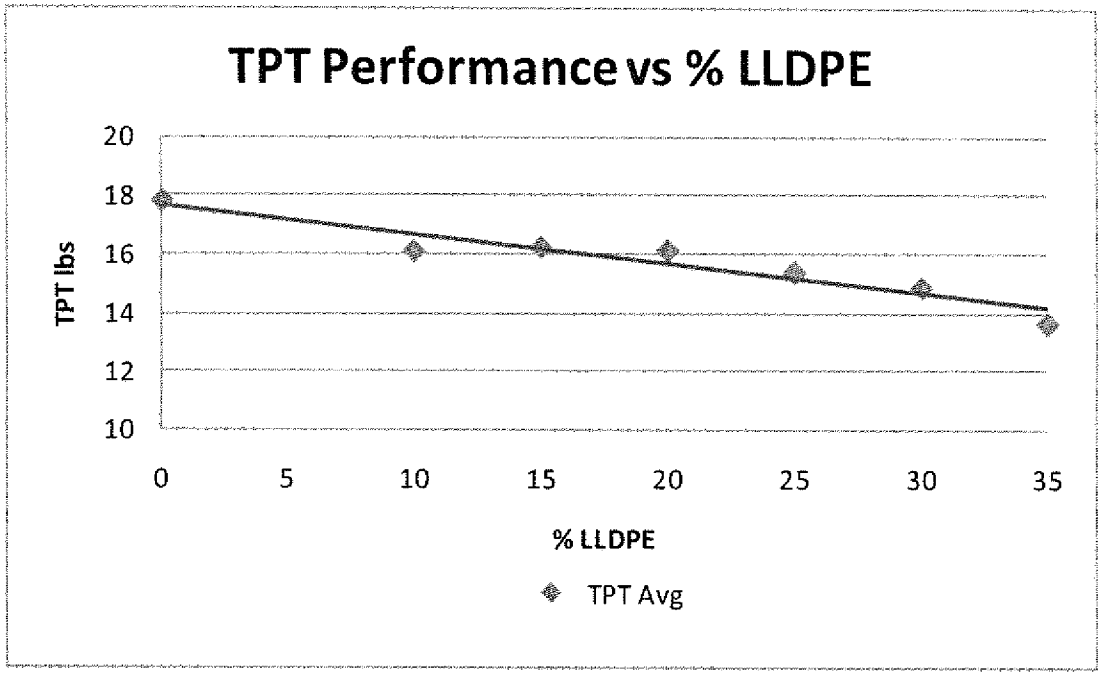
FIG. 3 is a graph depicting the load carrying capacity of drawtape samples containing different percentages of LLDPE prepared in accordance with the disclosed subject matter.

For purpose of these tests, fractional melt index LLDPE was used, wherein the term "fractional melt index" refers to a melt flow index of less than about 1.0 as measured by ASTM D1238 (2010). A ladder test was performed for various levels of LLDPE inputs, ranging from the 10 wt % to 35 wt % in increments of 5 wt %. The TPT scores of these samples compared to a control (~2% LLDPE) are provided in Table 2 below and in FIGS. 3-4. FIG. 3 demonstrates the load carrying capacity of the sample drawtapes prior to either tape failure or seal failure during the test. The load carrying capacity in the TPT procedure generally decreased as the LLDPE level increased.

TABLE 2

TPT score versus wt % LLDPE

| | Resin Blend Input Weight Percent | | | | | | Tape Pull Test (TPT) | | | |
|---|---|---|---|---|---|---|---|---|---|---|
| Run | MDPE | LDPE | LLDPE | Process Aid | Color | Slip Antiblock | Average lbs | Minimum lbs | Std. Dev. lbs | Percent That Fully Elongated |
| Control | 79.4 | 10 | 2 | 1 | 6 | 1.6 | 17.8 | 11.0 | 1.8 | 10.0 |
| 10% LLDPE | 81.4 | 0 | 10 | 1 | 6 | 1.6 | 16.1 | 12.4 | 1.2 | 45.0 |
| 15% LLDPE | 76.4 | 0 | 15 | 1 | 6 | 1.6 | 16.2 | 15.2 | 0.8 | 45.0 |
| 20% LLDPE | 71.4 | 0 | 20 | 1 | 6 | 1.6 | 16.1 | 11.7 | 1.3 | 75.0 |
| 25% LLDPE | 66.4 | 0 | 25 | 1 | 6 | 1.6 | 15.4 | 14.1 | 0.8 | 92.5 |
| 30% LLDPE | 61.4 | 0 | 30 | 1 | 6 | 1.6 | 14.9 | 13.7 | 0.7 | 87.5 |
| 35% LLDPE | 56.4 | 0 | 35 | 1 | 6 | 1.6 | 13.7 | 12.2 | 0.8 | 70.0 |

Figure 4:
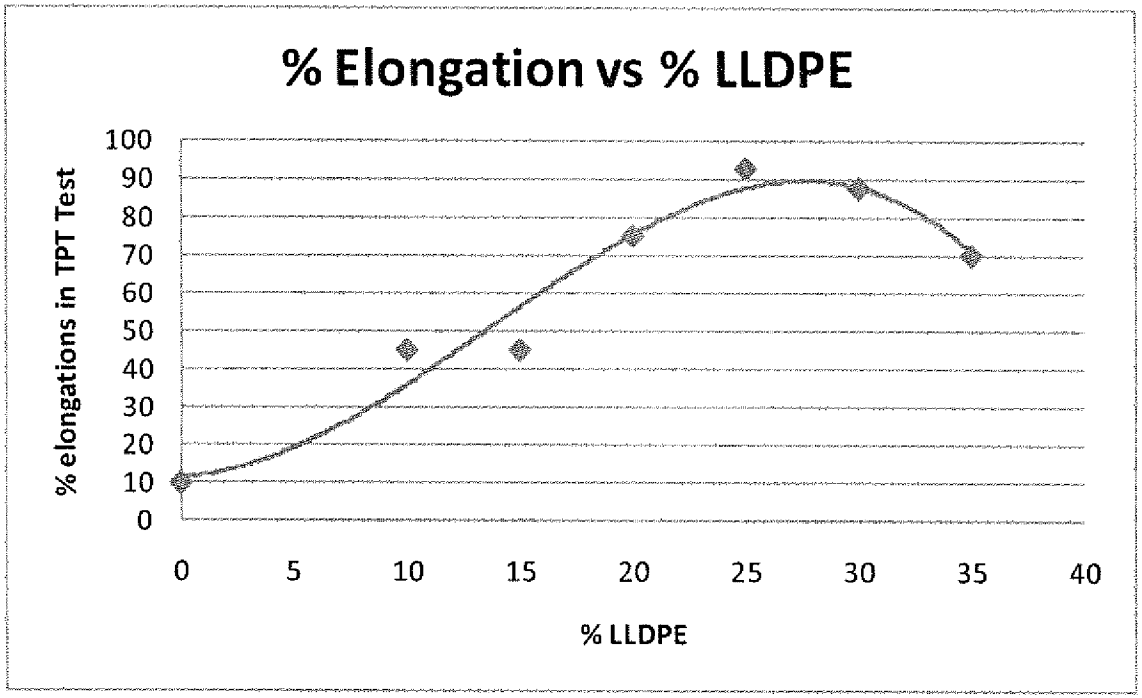
FIG. 4 is a graph depicting the percent of different drawtape bag samples in which the drawtape fully elongated during a Tape Pull Test without failure of the drawtape or of the seal with the bag.

FIG. 4 and Table 2 demonstrate the percent of bags with tapes that fully elongated during the TPT. The results ranged from 10.0%, achieved by using generally no LLDPE (i.e., ~2% LLDPE), to an optimum of 92.5% elongations with a drawtape containing 25 wt % LLDPE. An elongation level of 92.5% indicates that less than 10% (i.e., 7.5%) of the drawtape bags of this embodiment failed due to either tape breaks or seal breaks during the test.

For purpose of comparison, Table 2 further demonstrates that a drawtape prepared with 10% LLDPE and 81.4% major polymer component has better performance in a TPT procedure than a drawtape containing 10 wt % LDPE, 79.4 wt % major polymer component, 2 wt % LLDPE, and 0.6 wt % other additives.

Example 2

Tensile Strength

A drawtape containing 25 wt % LLDPE was prepared as described in Example 1. The tensile strength of this embodiment of the drawtape of the disclosed subject matter was compared to the tensile strength of the drawtape of three current commercial products.

Figure 5:
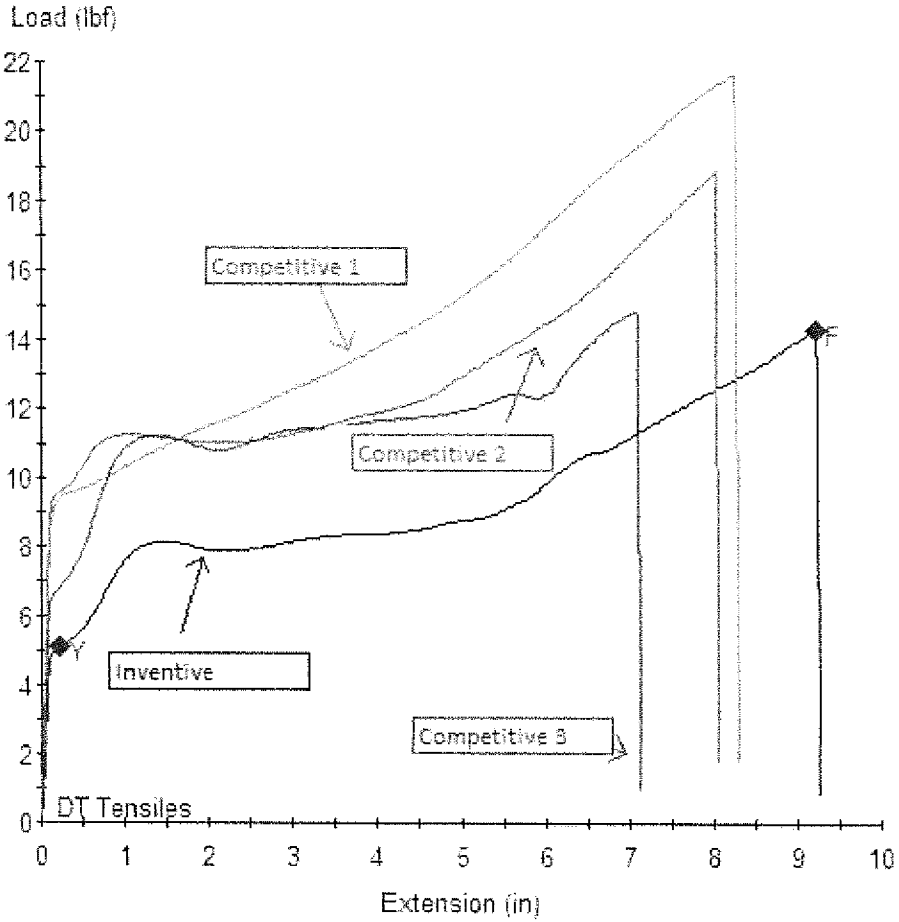
FIG. 5 is a tensile curve of a drawtape prepared in accordance with the disclosed subject matter compared to three other drawtapes with different compositions, wherein the curve depicts the force from the load cell (y-axis) and the extension of the jaws α-axis).

FIG. 5 presents the tensile curves for the drawtape of the disclosed subject matter (labeled "Inventive") as compared to that of three samples designated "Competitive 1," "Competitive 2," and "Competitive 3." Competitive 1 is the drawtape of a Glad® TKG bag, Competitive 2 is the drawtape of a 13J's 13 Gallon TKG bag by Poly-America®, and Competitive 3 is the drawtape of a currently available 13 Gallon TKG bag produced by Reynolds Consumer Products Inc. The tensile curves were determined according to the procedure in ASTM D882 (2010) using a 2 inch strip of drawtape. The yield strength for the tensile curve is defined in ASTM D882 (2010) Section "11.5 Yield Strength." The yield point is shown as point "D" in FIG. A1.1 in ASTM D882 (2010). The yield point is also defined in the Annex of ASTM D638 (2010) as noted in ASTM D882 (2010) as "the first point on the stress-strain curve at which an increase in strain occurs without an increase in stress." The yield point is representative of point B or D in FIG. A2.3 in ASTM D638 (2010). As demonstrated in FIG. 5 and Table 3, the amount of elongation for the 25 wt % LLDPE drawtape Inventive sample was higher than those of samples Competitive 1-3. As such, the data demonstrates the drawtape of the disclosed subject matter address the disadvantages and needs in the art.

TABLE 3

Comparison of samples Inventive and Competitive 1-3.

| Description | Thickness (inches) | Load at yield (lbs) | % Elongation at yield | Peak load (lbs) | Toughness (ft lb/in$^3$) | % Elongation at break |
|---|---|---|---|---|---|---|
| Inventive | 0.00215 | 5.1 | 10.2 | 14.3 | 1780 | 460 |
| Competitive 1 | 0.00210 | 9.2 | 8.7 | 21.6 | 2536 | 412 |
| Competitive 2 | 0.00238 | 9.5 | 8.1 | 18.8 | 1905 | 401 |
| Competitive 3 | 0.00212 | 6.7 | 8.6 | 14.8 | 1685 | 354 |

While the disclosed subject matter is described herein in terms of certain preferred embodiments, those skilled in the art will recognize that various modifications and improvements can be made to the disclosed subject matter without departing from the scope thereof. Moreover, although individual features of one embodiment of the disclosed subject matter can be discussed herein and not in other embodiments, it should be apparent that individual features of one embodiment can be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A drawtape comprising:

a film of a polymeric blend including:

between about 25 wt % and about 30 wt % linear low density polyethylene; and a major polymer component selected from medium density polyethylene, high density polyethylene, or combinations thereof.

2. The drawtape of claim 1, wherein the film comprises about 25 wt % linear low density polyethylene.

3. The drawtape of claim 1, wherein the linear low density polyethylene has a melt index of between about 0.25 and about 3.0 grams per 10 minutes per ASTM D1238 (2010).

4. The drawtape of claim 1, wherein the linear low density polyethylene has a melt index of between about 0.50 and about 1.0 grams per 10 minutes per ASTM D1238 (2010).

5. The drawtape of claim 1, wherein the linear low density polyethylene has a melt index of between about 0.80 and about 0.90 grams per 10 minutes per ASTM D1238 (2010).

6. The drawtape of claim 1, wherein the linear low density polyethylene has a base density of between about 0.910 and 0.925 grams per cubic centimeter per ASTM D792 (2008).

7. The drawtape of claim 1, wherein the linear low density polyethylene has a base density of between about 0.916 and 0.920 grams per cubic centimeter per ASTM D792 (2008).

8. The drawtape of claim 1, wherein the linear low density polyethylene includes an alpha olefin comonomer.

9. The drawtape of claim 1, wherein the linear low density polyethylene includes a comonomer having from 4 to 8 carbon atoms.

10. The drawtape of claim 1, wherein the linear low density polyethylene includes a comonomer selected from propylene, 1-butene, 1-pentene, 1-hexene, and 1-octene.

11. The drawtape of claim 1, wherein the major polymer has a melt index of between about 0.050 and about 0.50 grams per 10 minutes per ASTM D1238 (2010).

12. The drawtape of claim 1, wherein the major polymer has a melt index of between about 0.10 and about 0.20 grams per 10 minutes per ASTM D1238 (2010).

13. The drawtape of claim 1, wherein the major polymer has a base density of between about 0.926 and about 0.959 grams per cubic centimeter per ASTM D792 (2008).

14. The drawtape of claim 1, wherein the major polymer has a base density of between about 0.939 and about 0.940 grams per cubic centimeter per ASTM D792 (2008).

15. The drawtape of claim 1, further comprising an additive selected from a colorant, a slip additive, an antiblock agent, a processing aid, or combinations thereof.

16. The drawtape of claim 1, wherein the drawtape is a single layer.

17. A drawtape bag comprising:

first and second thermoplastic body panels joined along a pair of opposing sides and a bottom bridging the opposing sides, the joined first and second body panels defining a mouth disposed opposite the bottom; and a drawtape disposed proximate the mouth of the bag, the drawtape comprising a film of a polymeric blend including:

a) between about 25 wt % and about 30 wt % linear low density polyethylene; and b) a major polymer component selected from medium density polyethylene, high density polyethylene, or combinations thereof.

18. The drawtape bag of claim 17, where the drawtape has a load carrying capacity of at least about 10 lbs in a tensile direction in an ASTM D882 (2010) test.

19. The drawtape bag of claim 18, where the drawtape has a load carrying capacity of less than or equal to about 17 lbs in a tensile direction in an ASTM D882 (2010) test.

20. The drawtape bag of claim 18, where the drawtape has a load carrying capacity of at least about 14 lbs in a tensile direction in an ASTM D882 (2010) test.

21. The drawtape bag of claim 20, where the drawtape has a load carrying capacity of less than or equal to about 17 lbs in a tensile direction in an ASTM D882 (2010) test.

22. The drawtape bag of claim 17, wherein the drawtape has an elongation at break of at least about 425% in an ASTM D882 (2010) test.

23. The drawtape bag of claim 22, wherein the drawtape has an elongation at break of about 460% in an ASTM D882 (2010) test.

24. The drawtape bag of claim 17, wherein the drawtape is secured to at least one of the first and second panels.

25. The drawtape bag of claim 24, wherein the drawtape is secured by a thermal bond.

26. The drawtape bag of claim 25, wherein the drawtape is capable of at least about 120% elongation without failure of the drawtape or the thermal bond in a Tape Pull Test.

27. The drawtape bag of claim 26, wherein the drawtape is capable of about 138% elongation without failure of the drawtape or the thermal bond in a Tape Pull Test.

28. A method of making a drawtape comprising:

providing a polymeric blend comprising a) between about 25 wt % and about 30 wt % linear low density polyethylene; and b) a major polymer component selected from medium density polyethylene, high density polyethylene, or combinations thereof;

forming the polymeric blend into a film; and shaping the film into a drawtape.

29. The method of claim 28, further comprising dry blending the linear low density polyethylene with the major polymer component.

30. The method of claim 28, wherein the film is highly oriented in the machine direction when forming the polymeric blend into a film.

31. The method of claim 28, wherein said forming includes film blowing.

* * * * *